United States Patent [19]

DeVittorio

[11] 4,341,347

[45] Jul. 27, 1982

[54] ELECTROSTATIC SPRAYING OF LIQUIDS

[75] Inventor: Joseph M. DeVittorio, Will, Ill.

[73] Assignee: S. C. Johnson & Son, Inc., Racine, Wis.

[21] Appl. No.: 146,801

[22] Filed: May 5, 1980

[51] Int. Cl.[3] ..... B05B 5/02; B05B 1/34

[52] U.S. Cl. ..... 239/3; 239/706; 239/402; 239/406

[58] Field of Search ..... 239/3, 690, 691, 693, 239/704–706, 708, 402, 405, 406

[56] References Cited

U.S. PATENT DOCUMENTS

| | | | |
|---|---|---|---|
| 1,451,063 | 4/1923 | Anthony | 239/406 |
| 2,302,185 | 11/1942 | Campbell, Jr. | |
| 2,302,289 | 11/1942 | Bramston-Cook. | |
| 2,705,171 | 3/1955 | Ziherl. | |
| 3,141,259 | 7/1964 | Winters | 43/148 |
| 3,156,847 | 10/1964 | Schweriner. | |
| 3,169,882 | 2/1965 | Juvinall et al. | |
| 3,212,211 | 10/1965 | Bennett | 43/148 |
| 3,382,091 | 5/1968 | Drum. | |
| 3,589,607 | 6/1971 | Wolf et al. | 239/416 X |
| 3,613,993 | 10/1971 | Gourdine et al. | 239/3 |
| 3,625,424 | 12/1971 | Mantica | 239/3 |
| 3,633,825 | 1/1972 | Waldron | 239/406 X |
| 3,648,401 | 3/1972 | Stains | 43/129 |
| 3,692,241 | 9/1972 | Walberg. | |
| 3,698,635 | 10/1972 | Sickles | 239/3 |
| 3,700,168 | 10/1972 | Ferrant | 239/3 |
| 3,702,306 | 11/1972 | Waldron | 252/305 |
| 3,793,762 | 2/1974 | Stains | 43/124 |
| 3,802,625 | 4/1974 | Buser et al. | |
| 3,815,820 | 6/1974 | Probst. | |
| 3,837,573 | 9/1974 | Wagner | 118/621 X |
| 3,865,506 | 2/1975 | Gerlach | 415/213 R |
| 3,900,165 | 8/1975 | Parke et al. | 239/375 |
| 3,905,330 | 9/1975 | Coffee | 239/706 X |
| 4,004,733 | 1/1977 | Law | 239/3 |
| 4,055,300 | 10/1977 | Binoche | 239/418 X |
| 4,114,810 | 9/1978 | Masuda | 239/706 |
| 4,163,520 | 8/1979 | Garcia et al. | 239/707 |
| 4,168,327 | 9/1979 | Law | 427/4 |

FOREIGN PATENT DOCUMENTS

| | | |
|---|---|---|
| 234454 | 7/1961 | Australia. |
| 240295 | 8/1962 | Australia. |
| 1223451 | 6/1964 | France. |
| 1366864 | 6/1964 | France. |
| 77/4019 | 6/1977 | South Africa. |
| 813388 | 5/1959 | United Kingdom. |
| 1104461 | 2/1968 | United Kingdom. |

OTHER PUBLICATIONS

Brett, R. L. *Micron-Generation TM; Droplet Sizes, Their Measurement and Effectiveness,* In Pyrethrum Post. pp. 103–109 Apr. 1974.

Harrell, E. A., *Insect Control and Residues in Sweet Corn Using Ground Equipment for Treating with Low-Volume Formulations* In Journal of Economic Entomology, pp. 988–991, vol. 60, No. 1.

*Primary Examiner*—Andres Kashnikow

[57] ABSTRACT

Liquid is sprayed from a nozzle by subjecting it to a vortex air flow which breaks it into particles of about five to twenty microns, and, while the liquid particles are entrained in the liquid flow they pass by a needle shaped charging electrode extending into the flow transversely of the vortex flow axis. This imposes a high electrostatic charge on the particles to improve their spray characteristics.

12 Claims, 7 Drawing Figures

ELECTROSTATIC SPRAYING OF LIQUIDS

BACKGROUND OF THE INVENTION

1. Field of the Invention

This invention relates to electrostatic spraying of finely divided liquid particles and in particular it concerns novel method and apparatus for finely dividing liquid particles, applying an electrostatic charge to the divided particles and then spraying the charged particles into the atmosphere.

2. Description of the Prior Art

The patent invention is particularly suitable for the spraying of pesticides. As taught by U.S. Pat. No. 3,648,401 large areas are most effectively covered by sprayed insecticide when the major portion of the insecticide particles being sprayed are in the size range of about five to twenty microns. Particles of such small size are carried over very large distances; and, because a larger number of particles can be formed from a given amount of insecticides, when it is finely divided, the resulting spray is more likely to contact an insect than is a spray whose particles are not so finely divided. It has also been found that an effective spray of about five to twenty micron size particles is best achieved using a relatively low stream generating pressure, for example, about 0.3 kilograms per square centimeter. U.S. Pat. No. 3,900,165 describes a spraying apparatus for forming and spraying particles in the five to fifteen micron size range using a four psi air pressure. That apparatus comprises an air pressure chamber to which air is supplied at low pressure and a nozzle body located inside the chamber. The nozzle body has a series of converging spiral passages that receive air from the air chamber and direct it into a central mixing chamber which opens axially to a discharge opening from the air chamber. A liquid conduit also opens into the mixing chamber. As air enters the mixing chamber through the spiral passages it swirls in the form of a vortex and when liquid from the conduit enters the mixing chamber the swirling air breaks up the liquid into very small particles. Although the vortex velocity is high, the axial flow rate of the air, and the liquid particles carried with it, are relatively low so that the discharge velocity of the sprayed liquid is quite low.

It is also known in the prior art to apply an electrical charge to sprayed liquid particles to enhance their dispersal and to cause the particles to attract themselves to the various surfaces being sprayed e.g., insects, leaves, etc. U.S. Pat. No. 4,004,733 describes an electrostatic spray nozzle system for such liquids as agricultural pesticides and paints. Also U.S. Pat. No. 4,163,520 describes a paint spray gun wherein paint particles are sprayed in a swirling action and pass by an external wire electrode.

The prior art electrostatic spray devices have not proven satisfactory when used to spray particles smaller than about fifty microns at low spray velocity. It has been found that when very small size particles, e.g., five to twenty microns in size, are sprayed at low velocity it was not possible with prior arrangement to provide a satisfactory electrostatic charge on the particles.

The present invention overcomes the above described problem of the prior art. With the present invention it is possible to form, electrostatically charge and spray very fine particles, e.g., five to twenty microns in size, with a high degree of effectiveness.

According to the present invention there is provided a vortex type particle forming and mixing device inside a housing wherein air is directed in spiral fashion into a particle forming and mixing chamber where it forms a vortex about a longitudinal axis and breaks liquid entering the particle forming and mixing chamber into very small size particles for axial passage through a discharge opening from the chamber. A charging electrode is provided for applying an electrostatic charge to the finely divided particles. This electrode, however, rather than being located at or outside the discharge opening or around the liquid stream, as in the prior art, is located within the particle forming and mixing chamber itself; and, more specifically, it is located downstream of the liquid supply and extends into the region of the vortex formed by the incoming air stream from the spiral passages. Because of the turbulence and high velocities present in the vortex nearly all of the finely divided liquid particles are exposed to the action of the electrode so that a very uniform and complete charging of the particles is achieved. Moreover, at the location where the particles encounter the electrode charge they are elongated due to the high shearing action of the swirling air in the chamber; and this enhances their ability to receive a charge. Thereafter, surface tension makes the particles more spherical in shape so that their tendency to lose their acquired electrical charge is minimized.

In a preferred embodiment of the invention the charging electrode takes the form of a single straight wire element which enters into the particle forming and mixing chamber transversely to the longitudinal axis of the vortex flow. The electrode extends a short distance beyond the longitudinal axis of the vortex flow. The wire electrode presents minimal interference with the swirling flow in the mixing chamber and at the same time it exposes a maximum amount of the liquid particles to its charging action. The location of the electrode is just beyond the location where the incoming liquid has been broken into discrete particles but where the particles have not yet dispersed to any substantial extent. Consequently all the particles pass very close to the electrode and receive maximum charge exposure. The air velocity in this region is also very high so that any particles which do impinge on the electrode are blown off by the rapidly swirling air, and liquid buildup on the electrode is avoided.

There has thus been outlined rather broadly the more important features of the invention in order that the detailed description thereof that follows may be better understood, and in order that the present contribution to the art may be better appreciated. There are, of course, additional features of the invention that will be described more fully hereinafter. Those skilled in the art will appreciate that the conception upon which this disclosure is based may readily be utilized as the basis for the designing of other arrangements for carrying out the several purposes of the invention. It is important, therefore, that this disclosure be regarded as including such equivalent arrangement as do not depart from the spirit and scope of the invention.

BRIEF DESCRIPTION OF THE DRAWINGS

A preferred embodiment of the invention has been chosen for purposes of illustration and description, and is shown in the accompanying drawings, forming a part of the specification, wherein:

FIG. 3 is an exploded perspective view of a vortex forming portion of the electrostatic spray nozzle of FIGS. 1 and 2;

DETAILED DESCRIPTION OF THE PREFERRED EMBODIMENT

Figures 1, 6, 7:
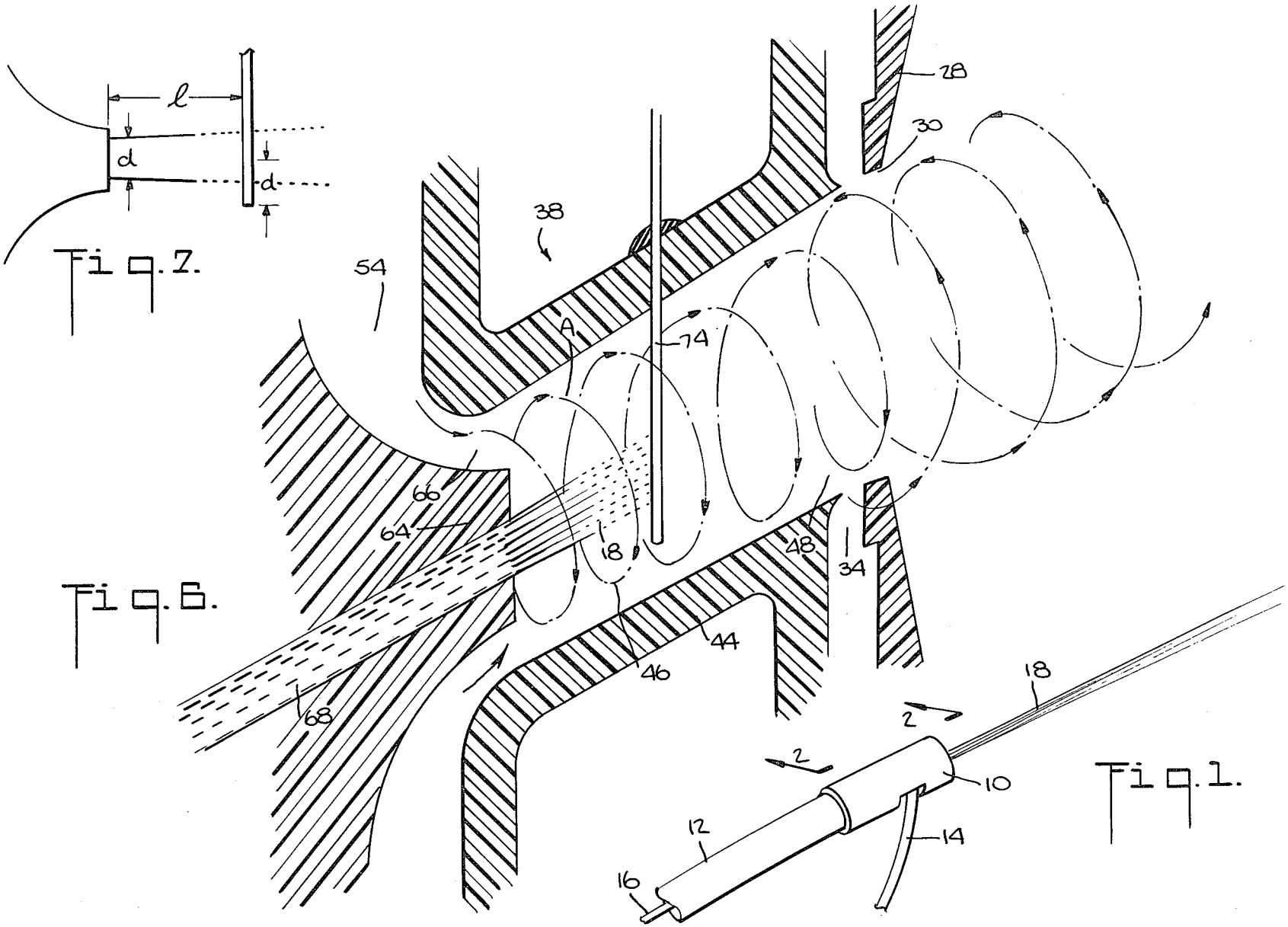
FIG. 1 is a perspective view of an electrostatic spray nozzle in which the present invention is embodied.
FIG. 6 is an enlarged fragmentary perspective view, taken in section and showing an electrostatic charge forming portion of the electrostatic spray nozzle of FIGS. 1-5.
FIG. 7 is a fragmentary portion of the spray nozzle shown in FIG. 2.

As shown in FIG. 1 the electrostatic spray nozzle comprises a barrel shaped housing 10 having an air supply hose 12 connected to one end and a liquid supply conduit 14 connected along its side. A high voltage electrical line 16 extends through the air supply hose 12 to the interior of the housing 10.

During operation of the spray nozzle air is supplied from an external source (not shown) at a low pressure, for example, less than about 0.3 kilograms per square centimeter, to the housing 10. At the same time a high direct-current voltage, e.g., 10,000 to 100,000 volts, is supplied from an external source (not shown) along the electrical line 16 to the nozzle. Also, liquid insecticide or other liquid to be sprayed is supplied from a reservoir (also not shown) through the liquid supply conduit 14 to the nozzle. The liquid can be pumped or aspirated into nozzle housing 10. The air flowing into the housing is guided (as will be described more fully hereinafter) to form vortices which act to entrain the liquid from the supply conduit 14 and to break it into extremely small droplets in the five to twenty micron range. These droplets become electrostatically charged inside the housing 10 and they are then ejected in the form of an ultra low volume spray 18.

The charged particles are prevented, by virtue of their like electrostatic charge, from coalescing or coming back together. In addition, because of the small size of the particles they are easily carried long distances by ambient air currents and they are attracted to surfaces such as plant leaves. Because of this, the electrostatic spray nozzle of this invention permits one to apply insecticide or other liquid chemical more evenly and over a greater area than was heretofore possible.

Figure 2:
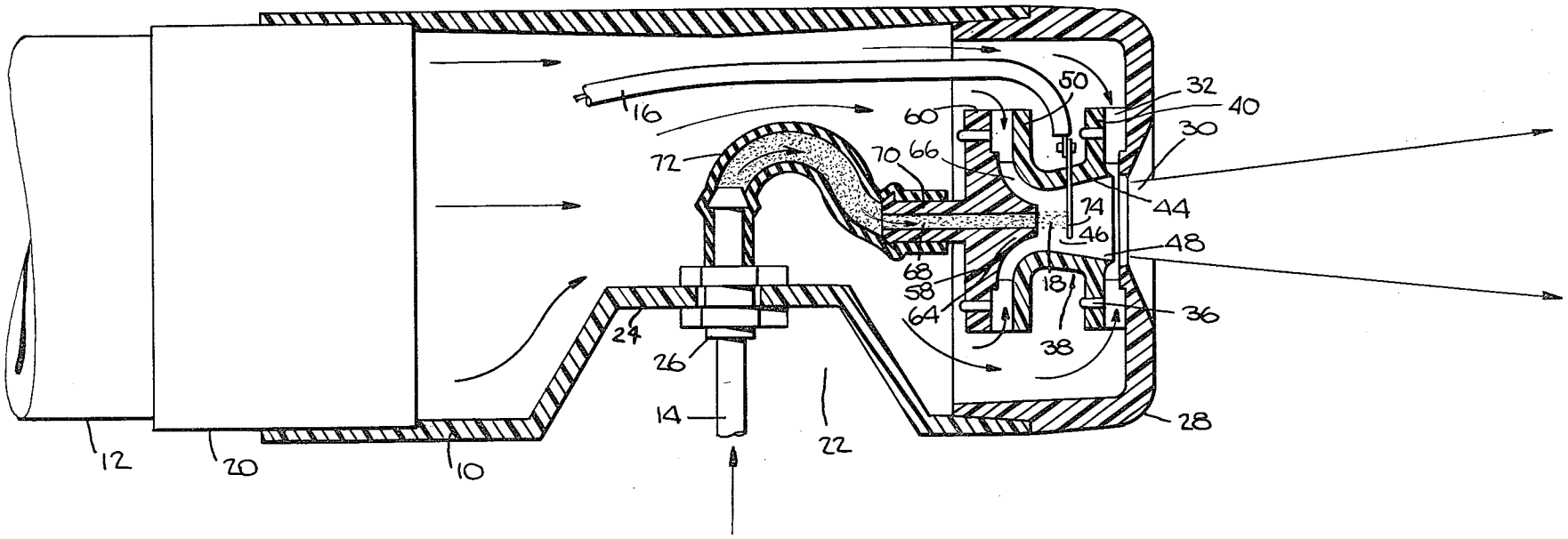
FIG. 2 is an enlarged section view taken along line 2—2 of FIG. 1.

The internal construction of the spray nozzle of FIG. 1 is shown in FIGS. 2-7. Except for the electrical line 16 and an electrode arrangement, to be described hereinafter, the nozzle is similar to a prior art spray nozzle sold by MicroGen Equipment Corporation of San Antonio Texas. As can be seen in FIG. 2, the housing 10 is hollow and cylindrical and it is preferably made of some suitable electrically non-conductive material such as plastic. The air supply hose 12 is connected to the end of the housing 10 by means of a sleeve 20 which fits over the hose and inside the housing. The housing 10 is also provided with an indentation 22 which forms a flat surface 24 for a connector 26 to the liquid supply conduit 14.

A cap 28 is fitted to the forward end of and forms part of the housing 10. The cap 28 also may be molded of plastic or other electrically non-conductive material. The cap 28 in turn is formed with an axial outlet opening 30 through which the spray 18 projects.

Figures 4, 5, 6:
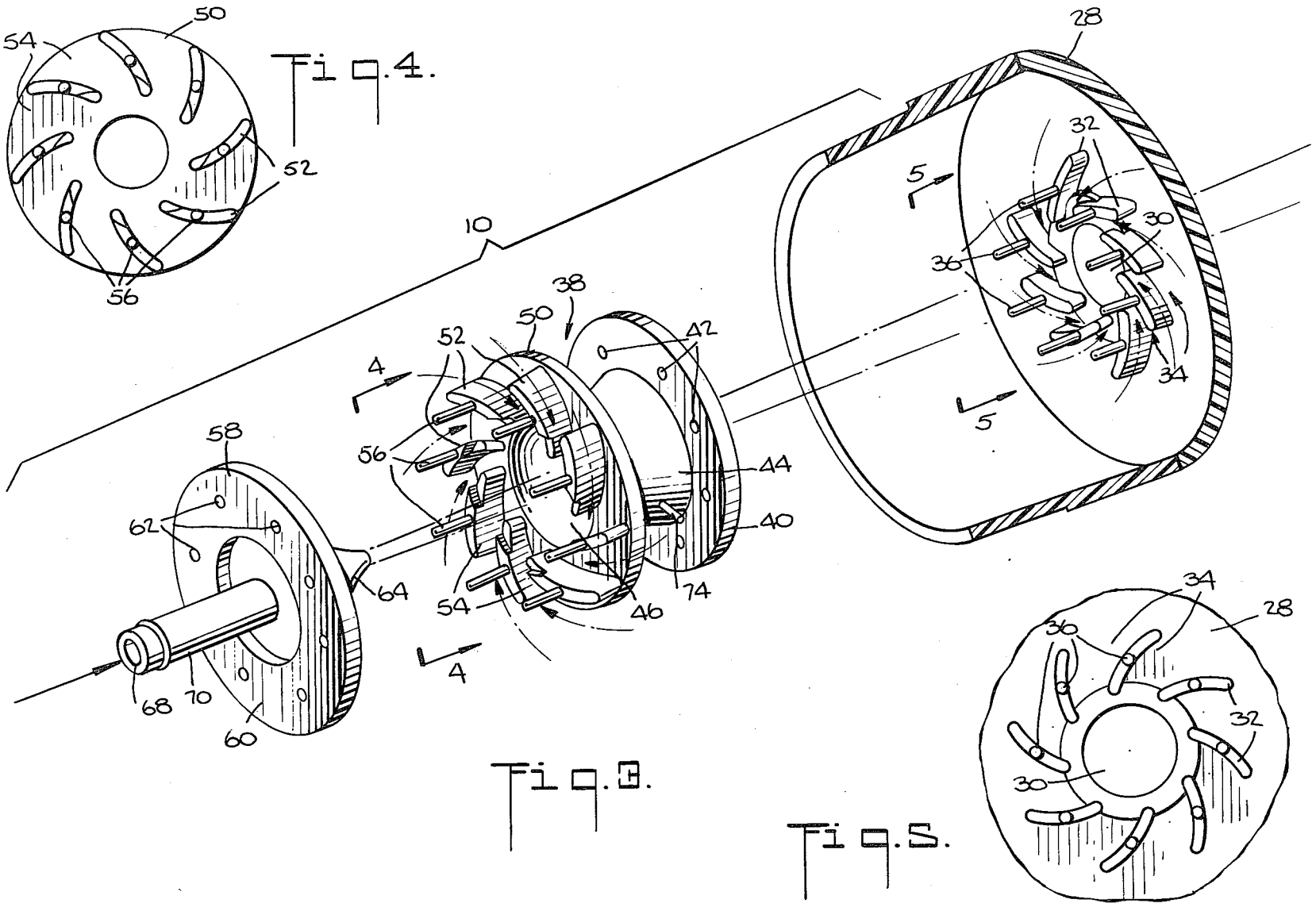
FIG. 4 is a view taken along line 4—4 of FIG. 3.
FIG. 5 is a view taken along line 5—5 of FIG. 3.

Just inside the cap 28 there are provided vortex forming, mixing and electrical charging elements. These elements are best seen in FIGS. 2-5. As can be seen, there are provided a series of second stage vortex forming vanes 32 on the inner surface of the cap 28. These vanes, as shown in FIG. 3 are distributed around the axial outlet opening 30 and they extend spirally out from the opening 30 about half way to the outer periphery of the cap 28. These vanes define between them second stage air channels 34 which, as can be seen in FIGS. 3 and 5, spiral inwardly in a counterclockwise direction looking toward the axial opening 30.

Locating pins 36 extend axially from each of the vanes 32. The vanes 32 and the pins 36 may be integral with and molded into the cap 28 itself.

A venturi forming element 38 is also provided inside the cap 28. This venturi forming element, which also may be of molded plastic or other electrically non-conductive material, includes a washer shaped forward wall 40 having holes 42 distributed thereabout to accommodate the locating pins 36 extending out from the second stage vortex forming vanes 32. The venturi forming element is mounted into the cap 28 by positioning its forward wall 40 against the vanes 32 with the pins 36 extending through the holes 42. With the forward wall so mounted, the second stage spiral air channels 34 are closed except at their ends.

The venturi forming element 38 also includes a conical section 44 which flares outwardly in a gradual manner from a particle forming and mixing region 46 forwardly to an outlet region 48 (FIG. 2) at the forward wall 40. The diameter of the conical section 44 at the outlet region 48 is about the same as the diameter of the axial outlet opening 30 while the diameter at the particle forming and mixing region 46 is significantly less.

The conical section 44 curves outwardly in a rearward direction from the particle forming and mixing region 46 to form a washer shaped rearward wall 50 of about the same diameter as the forward wall 40. The rearward wall 50 has formed its rearwardly facing surface a plurality of first stage vortex forming vanes 52 which define between them first stage spiral air channels 54 as can be seen in FIGS. 3 and 4. It will be noted by comparing FIGS. 4 and 5 that whereas the first stage air channels 54 spiral inwardly i.e., toward the particle forming and mixing region 46, in a clockwise direction, the second stage air channels 34 spiral inwardly in a counter-clockwise direction. Locating pins 56 are formed on and extend rearwardly from the first stage vortex forming vanes 54.

A liquid input element 58, which also may be formed of molded plastic material, is mounted on the rearward end of the venturi forming element 38. The liquid input element 58 has an outer washer shaped wall 60 of about the same diameter as the rearward wall 50; and the wall 60 is formed with openings 62 which accommodate the locating pins 56 on the first stage vortex forming vanes 52. When the liquid input element 58 is mounted on the venturi forming element 38, as shown in FIG. 2, the wall 60 closes the first stage spiral air channels 54 except at their outer ends and at particle forming and mixing region 46.

A needle shaped electrode 74 extends through and is mounted in a wall of the conical section 44 of the venturi forming element 38. The electrode 74 extends down into the particle forming and mixing region to a location beyond the central axis of the region but short of the opposite side of the conical section. The electrode 74 is silver soldered to the high voltage electrical line 16 at a location just outside the conical section 44 and preferably between the forward and rearward walls 40 and 50. The needle shaped electrode 74 may be mounted by drilling a hole through the wall of the conical section 44 and sealing the electrode into the hole by epoxy cement.

The liquid input element 58 extends inwardly, i.e., toward its axis, from its wall 60 and it also curves forwardly in the shape of a concave conical projection 64 which follows the contour of the venturi forming element between the first stage spiral air channels 54 and the particle forming and mixing region 46. This defines a first stage converging air passage 66 leading from the spiral air channels 54 to the particle forming and mixing region 46. The conical projection 64 terminates at the particle forming and mixing region 46.

An axial passageway 68 extends through the liquid input element 58 and opens at the particle forming and mixing region 46. A connector 70, through which the passageway 68 extends, projects rearwardly from the input element 58. A tube 72 (FIG. 2) extends inside the housing 10 to interconnect the connectors 26 and 70. Thus, liquid supplied via the liquid supply conduit 14 is guided through the tube 72 to the axial passageway 68 and from there to the particle forming and mixing region 46.

In the illustrated embodiment the housing 10 has a diameter of 4.4 centimeters. There are eight of the first stage spiral air channels 54 and eight of the second stage spiral air channels 34, each having an inlet cross section of about 0.3 square centimeters and an outlet cross section of about 0.1 square centimeters. The conical section 44 of the venturi forming element extends a distance of about 0.8 centimeters from the end of the conical projection 64 to the outlet region 48; and it flares outwardly at an included angle of about ten degrees. The first stage converging air passageway 66 has an outer curvature radius R (as viewed in FIG. 2) of about 2.9 centimeters and an inner curvature radius r of about 1.4 centimeters. The axial passageway 68 has a diameter of about 0.15 centimeters. The foregoing dimensions are by way of example only. The nozzle may be larger where greater capacity is desired, or smaller if less capacity is desired.

In operation of the spray nozzle, air is supplied at a low pressure, for example less than about 0.3 kilograms per square centimeter, to the interior of the housing 10. In the case where the nozzle is dimensioned as above described, the air may be supplied at a rate of about 200–600 liters per minute. This air has two possible routes of escape from the housing, namely, via the first stage spiral air channels 54 and via the second stage spiral air channels 34. As can be seen in FIG. 4, the cross section of each of the first stage spiral air channels 54 decreases toward its inner end (i.e. toward the central longitudinal axis of the housing 10), so that the air passing through those channels experiences a large increase in linear velocity. Moreover, because of the spiral shape of the passageways 54, this rapidly moving air is caused to swirl in a clockwise direction (looking forwardly of the nozzle). The swirling air from the spiral air channels 54 is given a gradual forward component as it passes through the first stage converging air passageway 66 so that, as can be seen in FIG. 6, the air enters the particle forming and mixing region 46 and undergoes a high velocity vortex flow therein along a generally helical clockwise path indicated by the arrows A. The axis of this path coincides with the longitudinal axis of the conical section 44. This vortex movement of high velocity air into the particle forming and mixing region 46 aspirates liquid into this region from the axial passageway 68. Again, in the described example, the aspiration rate may be anywhere from about 200 liters per minute to 600 liters per minute. The liquid first enters the region in the form of a continuum, but because of the very high velocity movement of air around the continuum the air shears off and entrains small particles of the liquid. These particles are thrown outwardly by centrifugal force and they are drawn forwardly by the helical pattern of the air flow so that they become separated from each other. The shearing action of the air which forms the particles, moreover, produces very fine particles of which the very large majority are in the range of five to twenty microns.

The swirling liquid particles and air are contained by the conical section 44 as they move through it; and the particles are allowed to move outwardly from each other so that they do not coalesce. At the same time however, they are maintained in a very concentrated arrangement. Also, the conical section maintains the spiral or rotating velocity of the particles very high while their forward velocity toward the axial outlet opening 30 remains relatively low.

As can be seen in FIGS. 6 and 7, the needle shaped electrode 74 extends diametrically through the conical section 44 into the vortex flow at a location where the liquid has been broken into small discrete particles which have attained a very high spiral or rotating velocity but which have not yet been thrown completely out to the outer walls of the conical section 44. By so positioning the electrode 74 all of the particles pass extremely close to the electrode and receive a very high charge. Moreover, the high velocity of the air pulling the particles along is believed to elongate the particles in the region of the electrode 74 and this enhances their charge accepting capability. Thereafter, as the relative velocity between the air and the particles decreases, the particles, because of surface tension, revert to a more spherical shape and become less likely to lose their charge. The high velocity of the air in the vicinity of the electrode 74 ensures that those liquid particles which actually impinge upon the electrode are blown off it before any build up can occur.

As the spirally flowing, and now electrically charged, particles flow along the conical section 44 from the electrode 74 toward the axial outlet opening 30, their like electrical charges cause them to repel each other and they tend to move out toward the walls of the conical section.

Just before the liquid particles reach the axial outlet opening 30 they encounter a high velocity air stream from the second stage spiral air channels 34. This high velocity air stream also swirls, but in a counterclockwise direction looking forwardly of the nozzle. The relative velocity between the clockwise and counterclockwise flowing streams is extremely high and the resulting impact and shearing action produces both further shearing of the liquid particles and breaks at least the larger ones into smaller sizes. The second stage air stream by rotating in a direction opposite to that of the first stage air stream also acts to reduce the centrifugal spreading of the liquid particles so that when they exit from the nozzle they project forwardly in a relatively well defined stream.

The above described configuration and positioning of the electrode 74 is especially effective in providing maximum particle charge without undesired liquid buildup on the electrode. The electrode 74 is preferably made of spring steel wire and is 0.51 millimeters in diameter; and it should extend transversely of the longitudinal axis of the vortex flow. The wire electrode 74 should be located forwardly of the outlet of the axial passageway 68 by a sufficient amount that the liquid continuum from the passageway will have broken into discrete particles before encountering the electrode. Otherwise the electrical charge from the electrode may leak back through the liquid continuum. As shown in FIG. 7 the distance (l) from the outlet of the axial passageway 68 to the electrode 74 is chosen to be about three times the diameter (d) of the passageway. Also, the electrode 74 should extend through and beyond the axis of the passageway 68 by an amount substantially equal to the diameter of the passageway.

Having thus described the invention with particular reference to the preferred form thereof, it will be obvious to those skilled in the art to which the invention pertains, after understanding the invention, that various changes and modifications may be made therein without departing from the spirit and scope of the invention as defined by the claims appended hereto.

I claim:

1. An electrostatic spray nozzle for spraying small size liquid particles of approximately five to fifteen microns, said spray nozzle comprising a housing having a longitudinal axis, means connected to supply pressurized air to said housing, said housing being formed with a spray outlet opening on said axis at one end of said housing for discharge of air and liquid particles being sprayed, vortex forming means inside said housing coaxial with and communicating directly with said discharge opening, said vortex forming means comprising an outer structure containing a particle forming and mixing region communicating with said opening and spiral passageways communicating between said particle forming and mixing region and the interior of said housing so that air passes from within said housing through said spiral passageways and undergoes a high velocity vortex flow in the particle forming and mixing chamber as it moves along said passageway and out through said spray outlet opening, liquid supply means comprising a liquid conduit extending from a source of liquid to be sprayed to said vortex forming means and opening into said particle forming and mixing chamber for fine atomization therein by said high velocity of said vortex flow, an electrode extending into said vortex forming means and terminating in said mixing chamber downstream of said liquid conduit and in the path of high velocity vortex flow of air and liquid particles therein, said electrode being located where the liquid has been broken into small discrete particles which have attained a high rotating velocity but which have not yet been thrown completely out to the outer walls of said particle forming and mixing chamber and means connected to apply a high voltage to said electrode.

2. An electrostatic spray nozzle according to claim 1 wherein said electrode is in the shape of a needle.

3. An electrostatic spray nozzle according to claim 2 wherein said electrode extends transversely of the longitudinal axis of said vortex flow.

4. An electrostatic spray nozzle according to claim 3 wherein said electrode extends through and beyond said longitudinal axis.

5. An electrostatic spray nozzle according to claim 1 wherein said electrode is located at a distance from said liquid conduit equal to about three times the diameter of said liquid conduit.

6. An electrostatic spray nozzle according to claim 1 wherein said electrode is made of stainless steel and is about 0.51 millimeters in diameter.

7. An electrostatic spray nozzle according to claim 1 wherein said electrode is located at a position sufficiently distant from said liquid conduit that it contacts only liquid particles which have been separated from the liquid continuum in said liquid conduit.

8. An electrostatic spray nozzle according to claim 3 wherein said electrode extends beyond said axis a distance equal to the diameter of said liquid conduit.

9. An electrostatic spray nozzle according to any of claims 1, 3, 4, 7 or 8 wherein a second stage vortex forming means is arranged downstream of the first mentioned vortex forming means and downstream of said electrode.

10. An electrostatic spray nozzle according to claim 9 wherein said second stage vortex forming means is constructed to produce a vortex of opposite rotational direction from the rotational direction produced by said first mentioned vortex forming means.

11. A method for spraying small size liquid particles in the size range of approximately five to fifteen microns, said method comprising the steps of directing air to flow as a vortex about an axis within a chamber, supplying liquid into said vortex at its axis so that said vortex forms and entrains particles from said liquid, and applying an electrical charge to the liquid particles thus formed by causing said particles entrained in said vortex to pass by a needle shaped electrode which extends into vortex flow transversely of said axis while said particles are rotating at a high velocity but before they have been thrown outwardly against the walls of said chamber and while maintaining a high electrical potential on said electrode.

12. A method according to claim 11 wherein said particles are subjected to a reverse vortex air flow following the application of said electrical charge.

* * * * *